US012599827B1

(12) United States Patent
Xu

(10) Patent No.: US 12,599,827 B1
(45) Date of Patent: Apr. 14, 2026

(54) BOXING ENTERTAINMENT DEVICE

(71) Applicant: Yihui Xu, Ganzhou (CN)

(72) Inventor: Yihui Xu, Ganzhou (CN)

( * ) Notice: Subject to any disclaimer, the term of this patent is extended or adjusted under 35 U.S.C. 154(b) by 0 days.

(21) Appl. No.: 19/194,968

(22) Filed: Apr. 30, 2025

(51) Int. Cl.
*A63B 69/32* (2006.01)
*A63B 71/06* (2006.01)

(52) U.S. Cl.
CPC ..... *A63B 69/32* (2013.01); *A63B 71/0622* (2013.01); *A63B 2071/0625* (2013.01); *A63B 2220/801* (2013.01); *A63B 2220/833* (2013.01); *A63B 2225/20* (2013.01); *A63B 2225/74* (2020.08); *A63B 2244/102* (2013.01)

(58) Field of Classification Search
CPC ..... A63B 2220/17; A63B 2220/53; A63B 2220/801; A63B 2220/833; A63B 2208/12; A63B 2244/10; A63B 2244/102; A63B 2209/00; A63B 69/224; A63B 69/222; A63B 69/305; A63B 69/34; A63B 69/322; A63B 69/22; A63B 69/20; A63B 69/32; A63B 69/0622; A63B 71/0622; A63B 2071/0625; A63B 2225/20; A63B 2225/74
See application file for complete search history.

(56) References Cited

U.S. PATENT DOCUMENTS

| | | | | |
|---|---|---|---|---|
| 11,534,673 | B2 * | 12/2022 | Morin | A63B 71/0622 |
| 11,638,863 | B2 * | 5/2023 | Baer | A63B 69/32 482/84 |
| 2014/0366645 | A1 * | 12/2014 | Tsai | G01L 5/0052 73/862.041 |
| 2020/0376313 | A1 * | 12/2020 | Sperling | A63B 5/08 |
| 2021/0236903 | A1 * | 8/2021 | Briel | A63B 71/0622 |
| 2021/0394034 | A1 * | 12/2021 | Waters | A63B 69/325 |

OTHER PUBLICATIONS

Khan Academy YouTube video "What is inside a universal remote control" posted Sep. 15, 2012 (What is inside a universal remote control? | Electrical engineering | Khan Academy—YouTube) (Year: 2012).*

* cited by examiner

*Primary Examiner* — Loan B Jimenez
*Assistant Examiner* — Jonathan A Dicuia
(74) *Attorney, Agent, or Firm* — HOWARD M COHN and Associates, LLC

(57) ABSTRACT

A boxing entertainment device includes a shell, a main circuit board arranged in the shell, and a plurality of sub circuit boards arranged in the shell. Each of the plurality of sub circuit boards is electrically connected to the main circuit board. The plurality of sub circuit boards are arranged in an array. The boxing entertainment device further includes a plurality of striking parts corresponding to the plurality of sub circuit boards respectively.

14 Claims, 24 Drawing Sheets

BOXING ENTERTAINMENT DEVICE

FIELD

The present disclosure relates to game entertainment, and in particular, to a boxing entertainment device.

BACKGROUND

With development of society, the pace of modern people's work and life is getting faster and faster, which leads to relatively high mental pressure for modern people. At present, there are various types of products on the market that can help people release their emotions and relieve stress. A boxing entertainment device is one of them. It not only helps relieve stress but also functions as physical exercise and entertainment. In existing technologies, the boxing entertainment device includes a housing, on which there are multiple striking parts, and there are a circuit board and a striking detector inside the housing. When in use, the user can strike the striking parts on the housing with their fist. The boxing entertainment device recognizes occurrence of striking actions through the striking detector and feeds back a signal to the circuit board. Then, it can inform the user whether the striking is successful, the number of strikes, and etc. However, in existing boxing entertainment devices, the circuit board is an inseparable integral board, which is not conducive to internal structural layout of the device. Moreover, since sufficient space needs to be reserved between each striking part to prevent the first from striking multiple striking parts simultaneously. Therefore, the position on the circuit board corresponding to each striking part is generally in an empty state, that is, no electronic components are set at this position, resulting in excessive and wasted space on the circuit board.

SUMMARY

In order to solve shortcomings in existing technologies, the present disclosure is to provide a boxing entertainment device.

A boxing entertainment device provided by an embodiment of the present disclosure includes a housing, a main circuit board arranged in the housing; and a plurality of sub circuit boards arranged in the housing. Each sub circuit board is electrically connected to the main circuit board and is arranged in an array.

In one or more embodiments of the present disclosure, the boxing entertainment device further includes a plurality of striking parts corresponding to the plurality of sub circuit boards respectively, and a plurality of striking detectors arranged on the plurality of sub circuit boards respectively, wherein each striking part is configured to be triggered when being struck.

In one or more embodiments of the present disclosure, the striking parts are elastic.

In one or more embodiments of the present disclosure, the striking detectors are press-type striking detectors, sensor-type striking detectors or a combination of the press-type striking detectors and the sensor-type striking detectors.

In one or more embodiments of the present disclosure, each press-type striking detector includes a first elastic button, a conductive portion arranged at a bottom of the first elastic button, a first conducting pin, and a second conducting pin, wherein the first conducting pin and the second conducting pin are in a constantly disconnected state; each striking part is configured to exert a force on the first elastic button to cause the first elastic button to deform when being struck, thus pushing the conductive portion to electrically connect the first conducting pin and the second conducting pin.

In one or more embodiments of the present disclosure, the striking parts are elastic.

In one or more embodiments of the present disclosure, the striking detectors are press-type striking detectors, sensor-type striking detectors or a combination of the press-type striking detectors and the sensor-type striking detectors.

In one or more embodiments of the present disclosure, each press-type striking detector includes a first elastic button, a conductive portion arranged at a bottom of the first elastic button, a first conducting pin, and a second conducting pin, wherein the first conducting pin and the second conducting pin are in a constantly disconnected state; each striking part is configured to exert a force on the first elastic button to cause the first elastic button to deform when being struck, thus pushing the conductive portion to electrically connect the first conducting pin and the second conducting pin.

In one or more embodiments of the present disclosure, the first conducting pin and the second conducting pin are printed on each sub circuit board.

In one or more embodiments of the present disclosure, the first conducting pin is provided with multiple first prongs, the second conducting pin is provided with multiple second prongs, and the first prongs and the second prongs are staggered with each other.

In one or more embodiments of the present disclosure, the sensor-type striking detectors are press sensors electrically connected to the sub circuit boards.

In one or more embodiments of the present disclosure, the boxing entertainment device further includes second elastic buttons arranged on the press sensors, wherein the striking parts are configured to exert a force on the second elastic buttons to cause the second elastic button to deform when being struck, thus transmitting a striking force to the press sensors.

In one or more embodiments of the present disclosure, the press sensor are thin-film press sensors.

In one or more embodiments of the present disclosure, each striking part includes a base portion arranged on the housing, an elastic member, and a striking contact portion arranged above a corresponding one of the sub circuit boards and exposed outside the housing, wherein the elastic member is arranged between the base portion and the striking contact portion, the striking contact portion is configured to exert a force on a corresponding one of the plurality of striking detectors to trigger the corresponding one of the plurality of striking detectors.

In one or more embodiments of the present disclosure, the striking parts are integrally made of an elastic material.

In one or more embodiments of the present disclosure, the plurality of sub circuit boards are arranged in a circular array.

In one or more embodiments of the present disclosure, the main circuit board is arranged at a center of the housing and the plurality of sub circuit boards are arranged surrounding the main circuit board to form the circular array.

In one or more embodiments of the present disclosure, the main circuit board and the plurality of sub circuit boards are arranged separately, and the plurality of sub circuit boards are arranged separately.

In one or more embodiments of the present disclosure, the number of the plurality of sub circuit boards is 5 or 6, correspondingly, the number of the plurality of striking parts is 5 or 6.

In one or more embodiments of the present disclosure, the plurality of sub circuit boards are arranged in a circular array.

In one or more embodiments of the present disclosure, the main circuit board is arranged at a center of the housing and the plurality of sub circuit boards are arranged surrounding the main circuit board to form the circular array.

A boxing entertainment device by another embodiment of the present disclosure includes a plurality of circuit boards arranged in an array.

In one or more embodiments of the present disclosure, the plurality of circuit boards are arranged in a circular array.

The beneficial effects of the present disclosure are: Through aforementioned structural configurations, the main circuit board and the plurality of sub circuit boards are installed within the housing, enabling a more flexible and rational layout of circuit boards within the boxing entertainment equipment. Moreover, it allows for the rational arrangement of electronic components on both the main circuit board and the sub circuit boards according to actual requirements, thereby avoiding excess space and wastage on the circuit boards.

BRIEF DESCRIPTION OF THE DRAWINGS

In order to more clearly illustrate technical solutions in the embodiments of the present disclosure, the accompanying drawings required in the description of the embodiments will be briefly introduced below. The accompanying drawings in the description below are only some embodiments of the present disclosure. For those of ordinary skilled in the art, other accompanying drawings can also be obtained based on these accompanying drawings without expending creative labor.

The present disclosure is further described below in conjunction with the accompanying drawings and embodiments.

DETAILED DESCRIPTION

Figure 1:
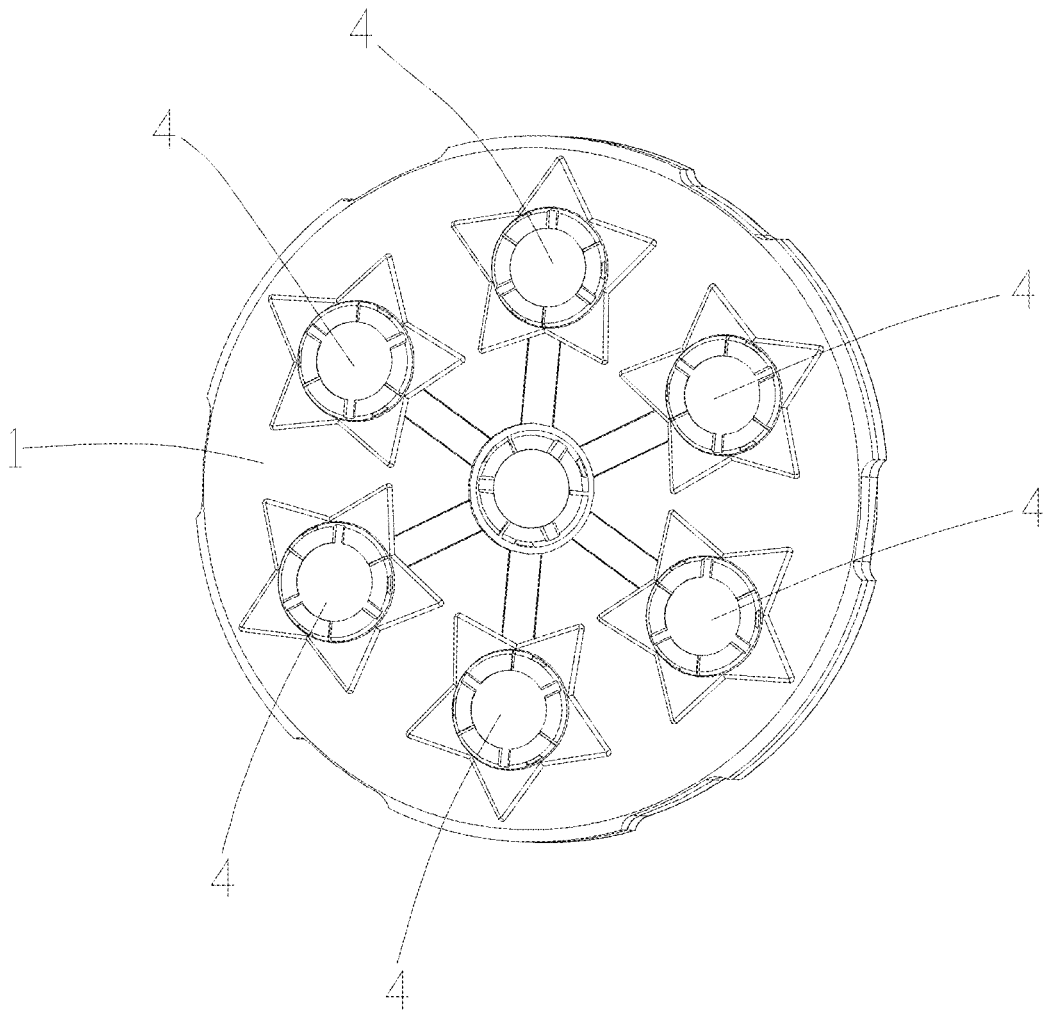
FIG. 1 is a schematic structural diagram of a boxing entertainment device according to an embodiment of the present disclosure, the boxing entertainment device including a housing in a first shape.
Figure 2:
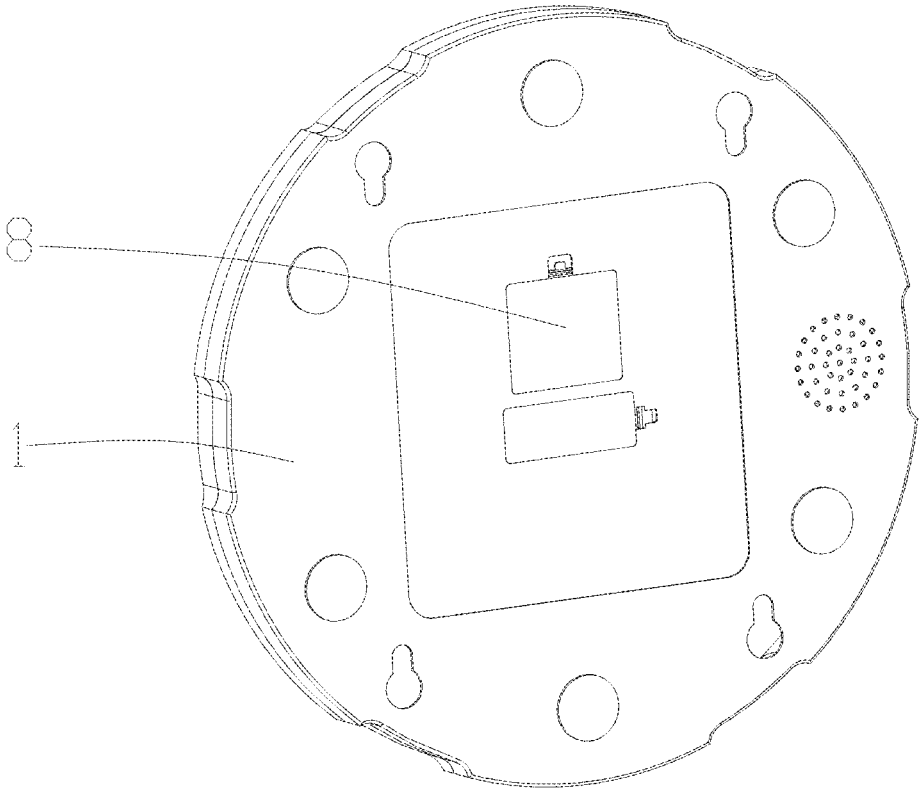
FIG. 2 is a schematic structural diagram of the boxing entertainment device of FIG. 1 from another angle.
Figure 3:
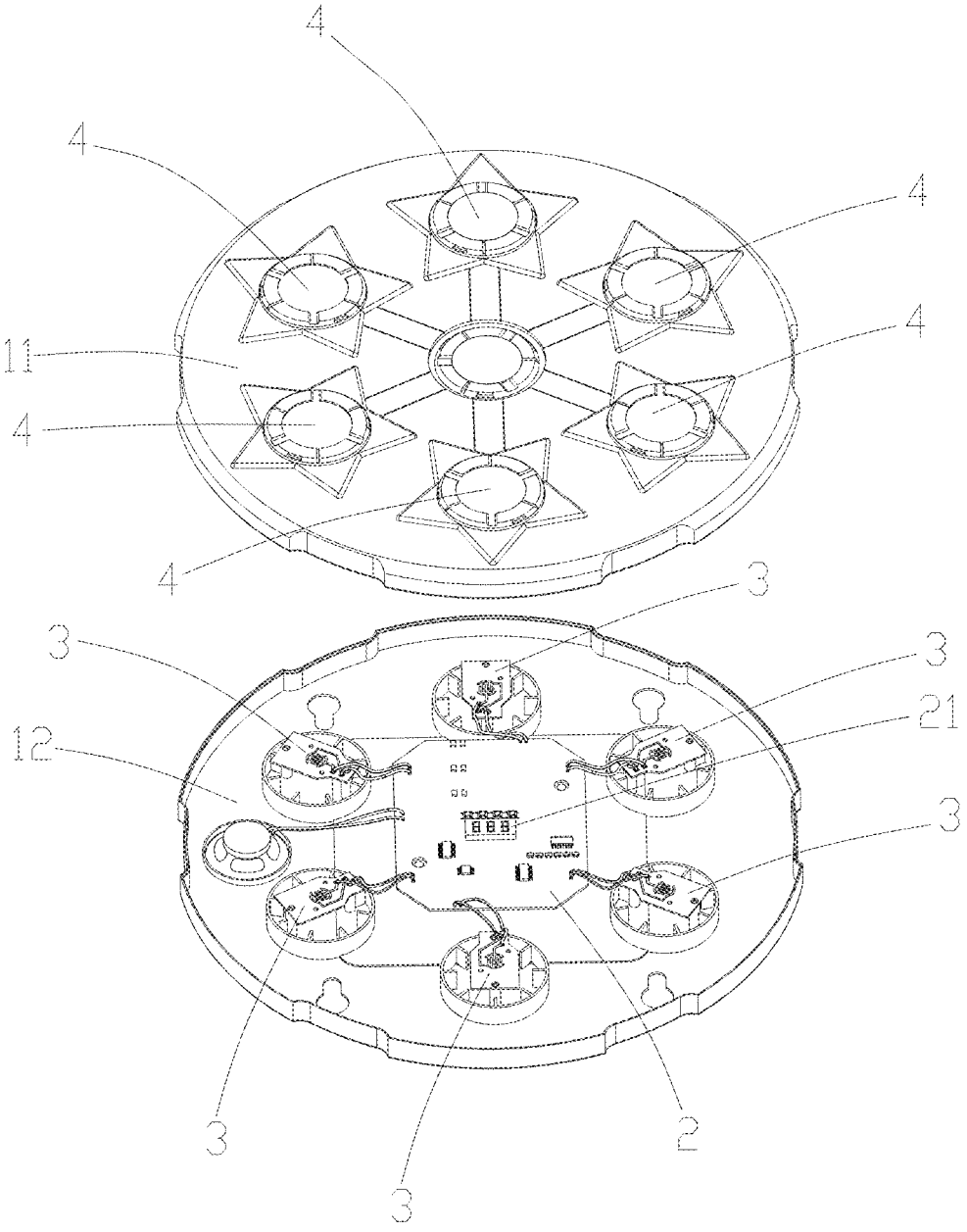
FIG. 3 is a schematic view of the boxing entertainment device of FIG. 1 showing an upper housing and striking parts detached from a lower housing.
Figure 4:
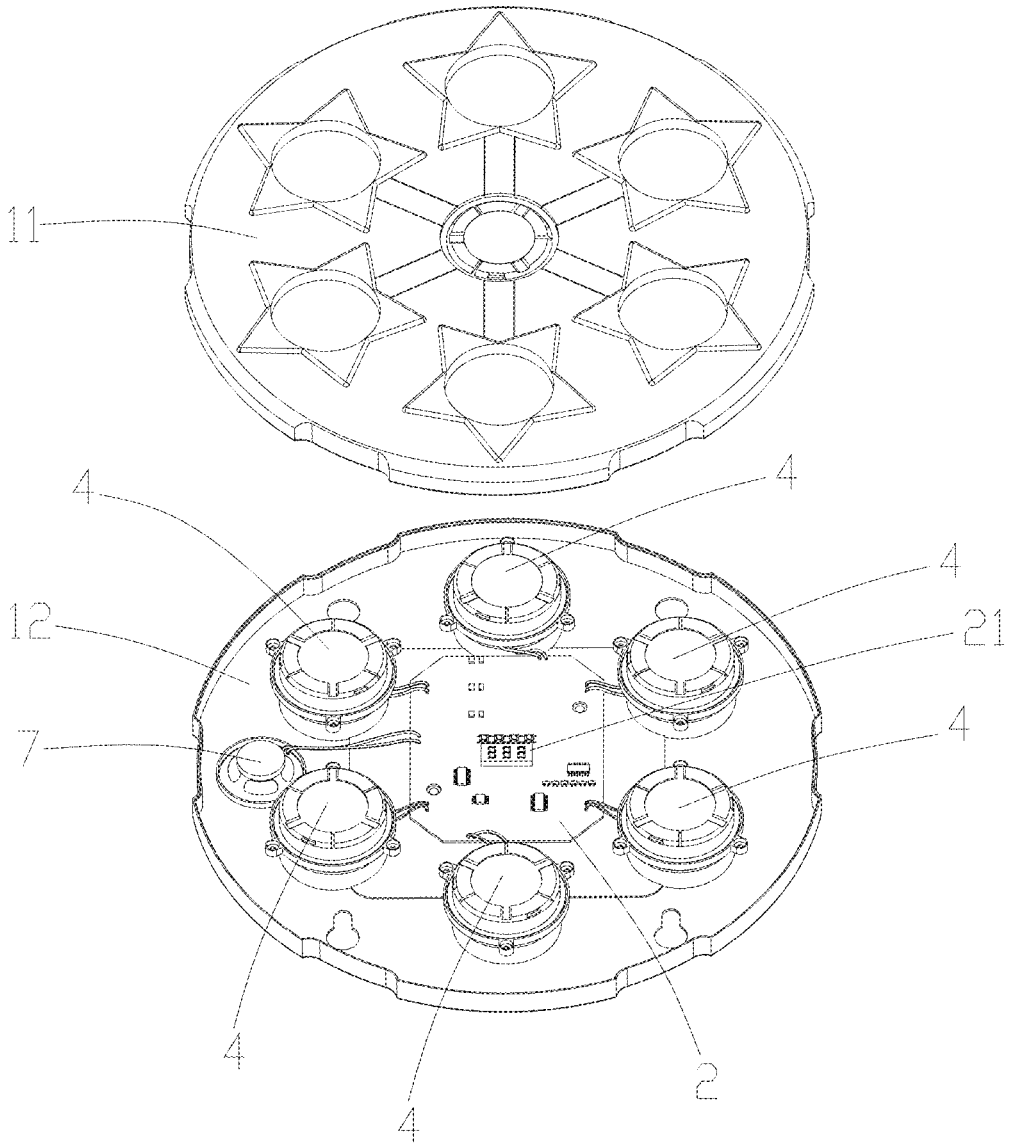
FIG. 4 is a schematic view of the boxing entertainment device of FIG. 1 showing the upper housing detached from the lower housing.
Figure 5:
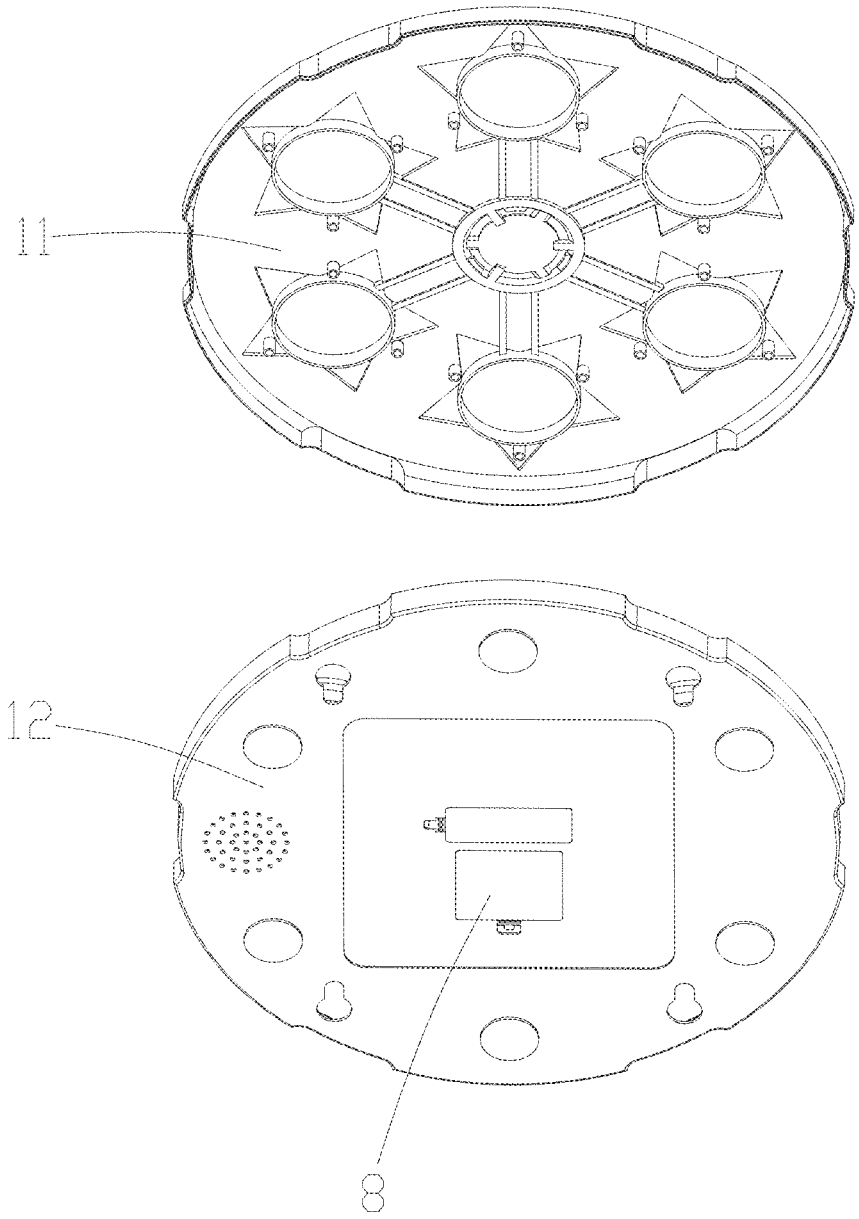
FIG. 5 is a schematic view of the boxing entertainment device of FIG. 4 from another angle.
Figure 6:
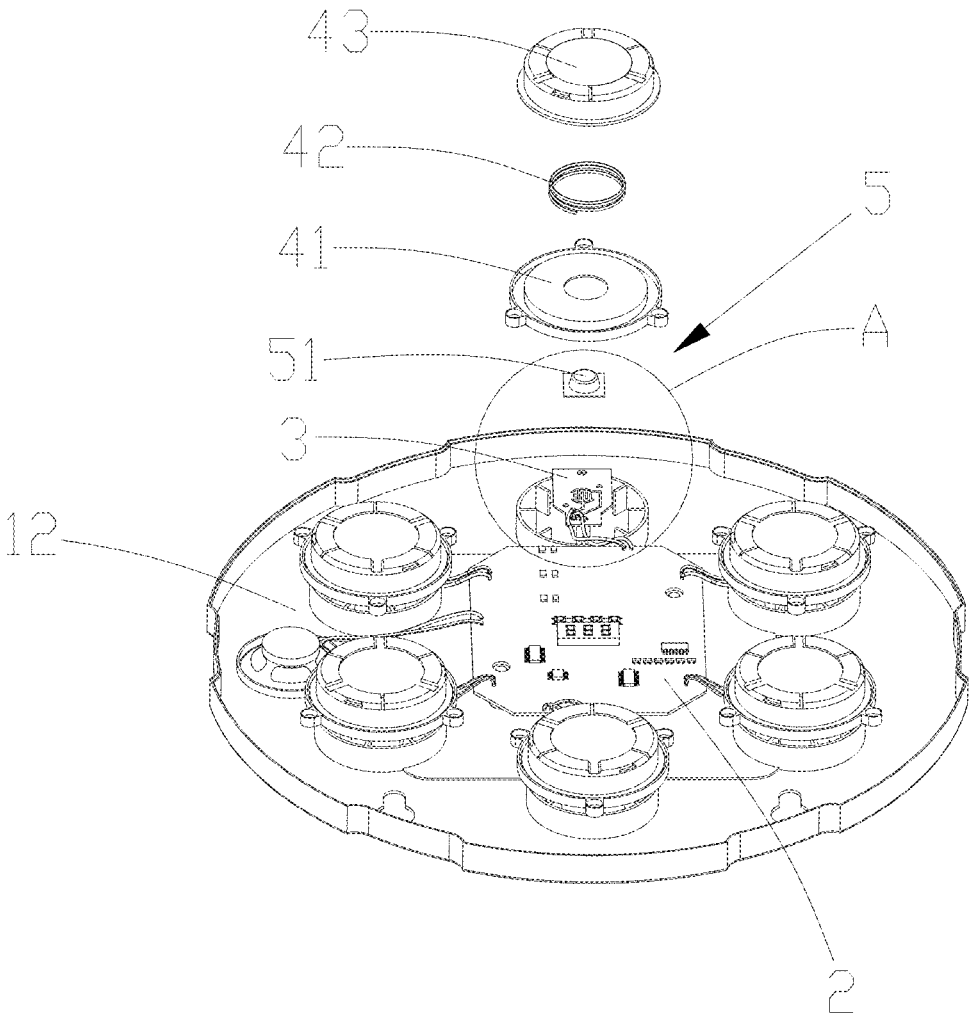
FIG. 6 is a is a schematic view of the boxing entertainment device of FIG. 1 with a first embodiment of a striking detector, the upper housing being not shown.
Figure 7:
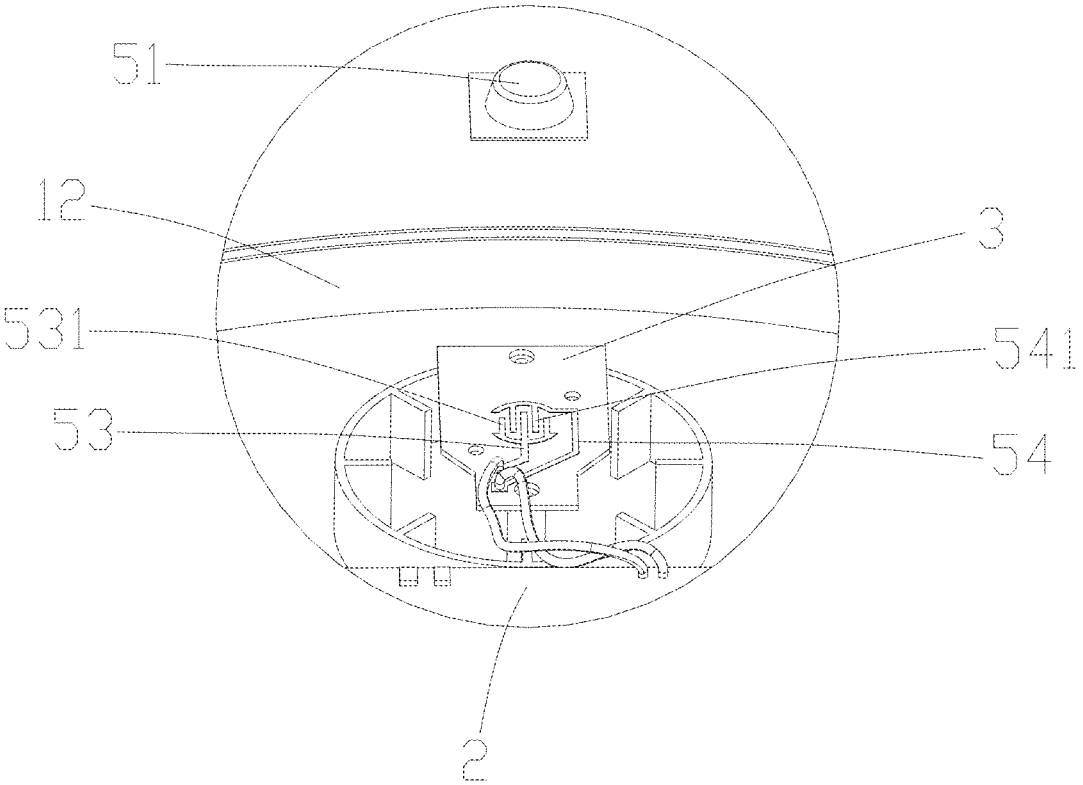
FIG. 7 is an enlarged view of the portion A shown in FIG. 6.
Figure 8:
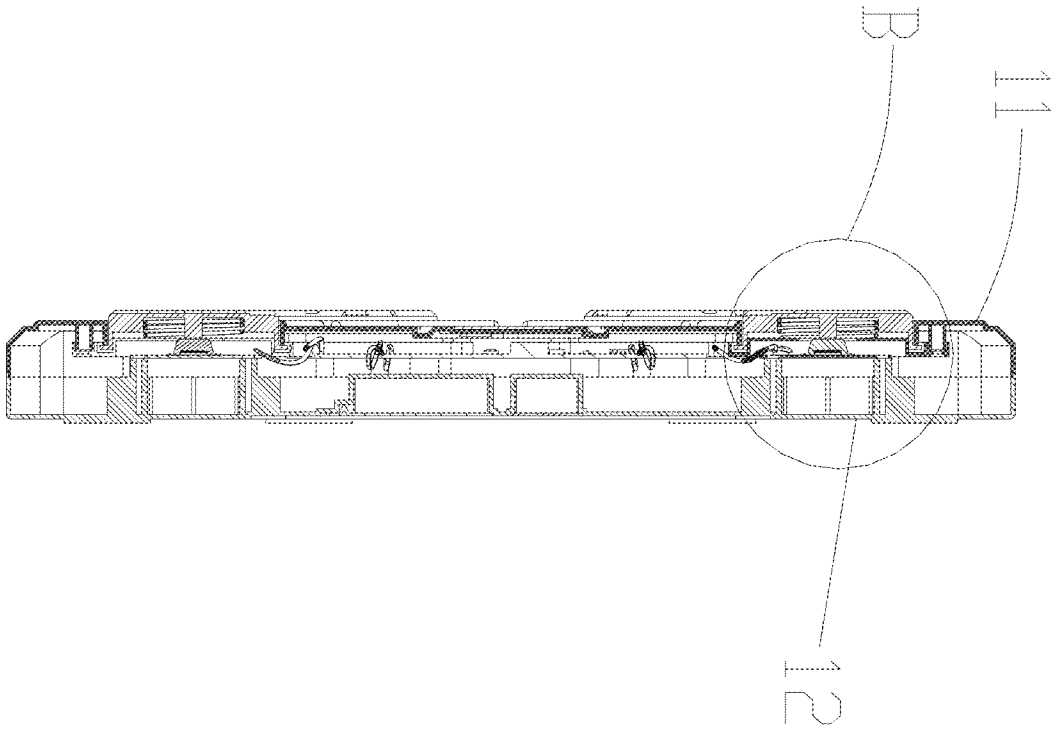
FIG. 8 is a cross-sectional view of the boxing entertainment device of FIG. 1 with the first embodiment of the striking detector, the upper housing being not shown.
Figure 9:
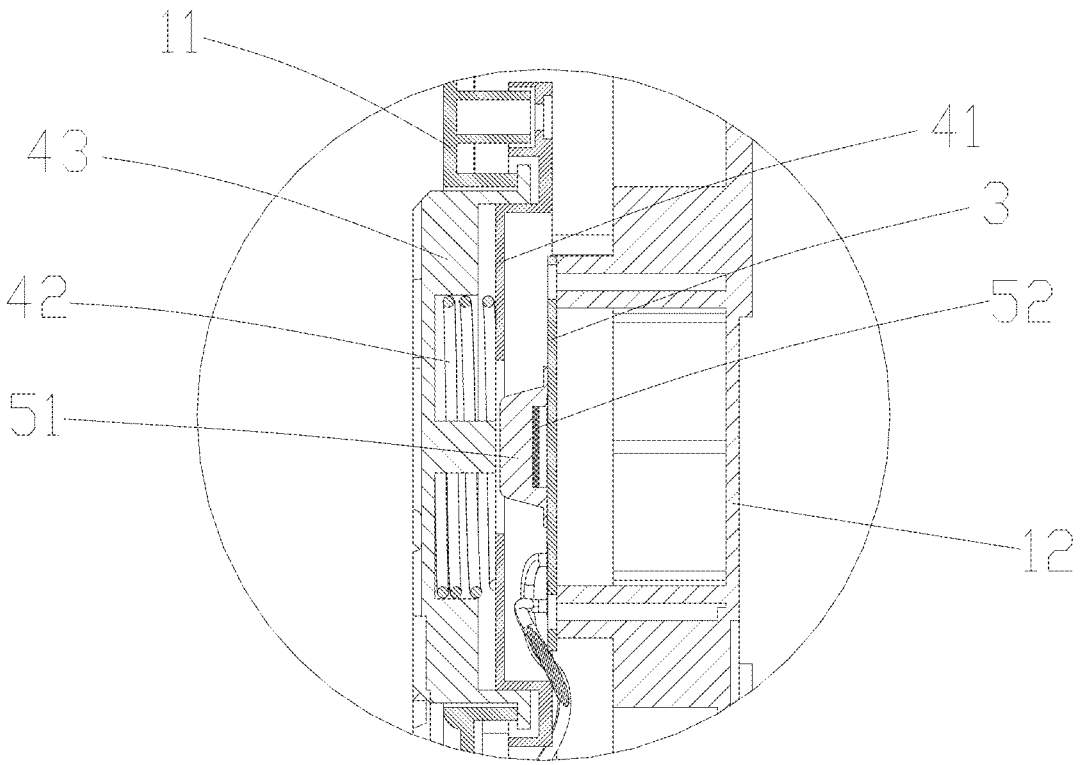
FIG. 9 is an enlarged view of the portion B shown in FIG. 8.
Figure 10:
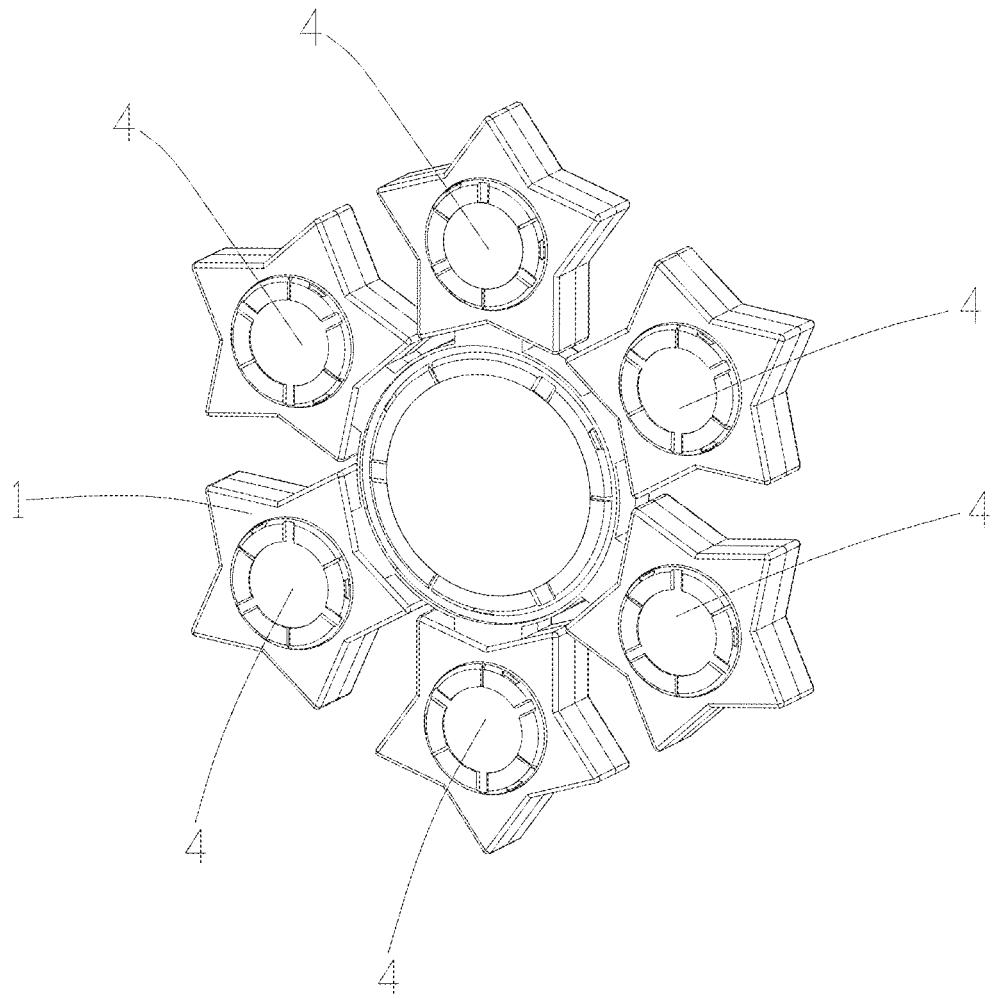
FIG. 10 is a schematic view of the boxing entertainment device including a housing in a second shape.
Figure 11:
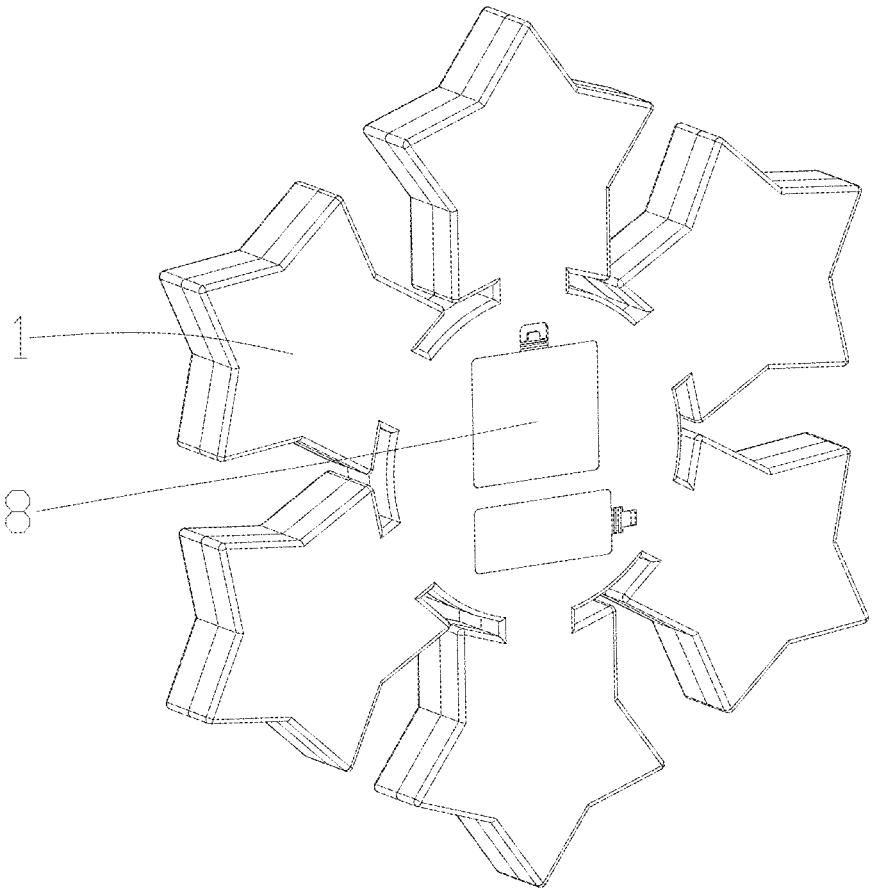
FIG. 11 is a schematic structural diagram of the boxing entertainment device of FIG. 10 from another angle.
Figure 12:
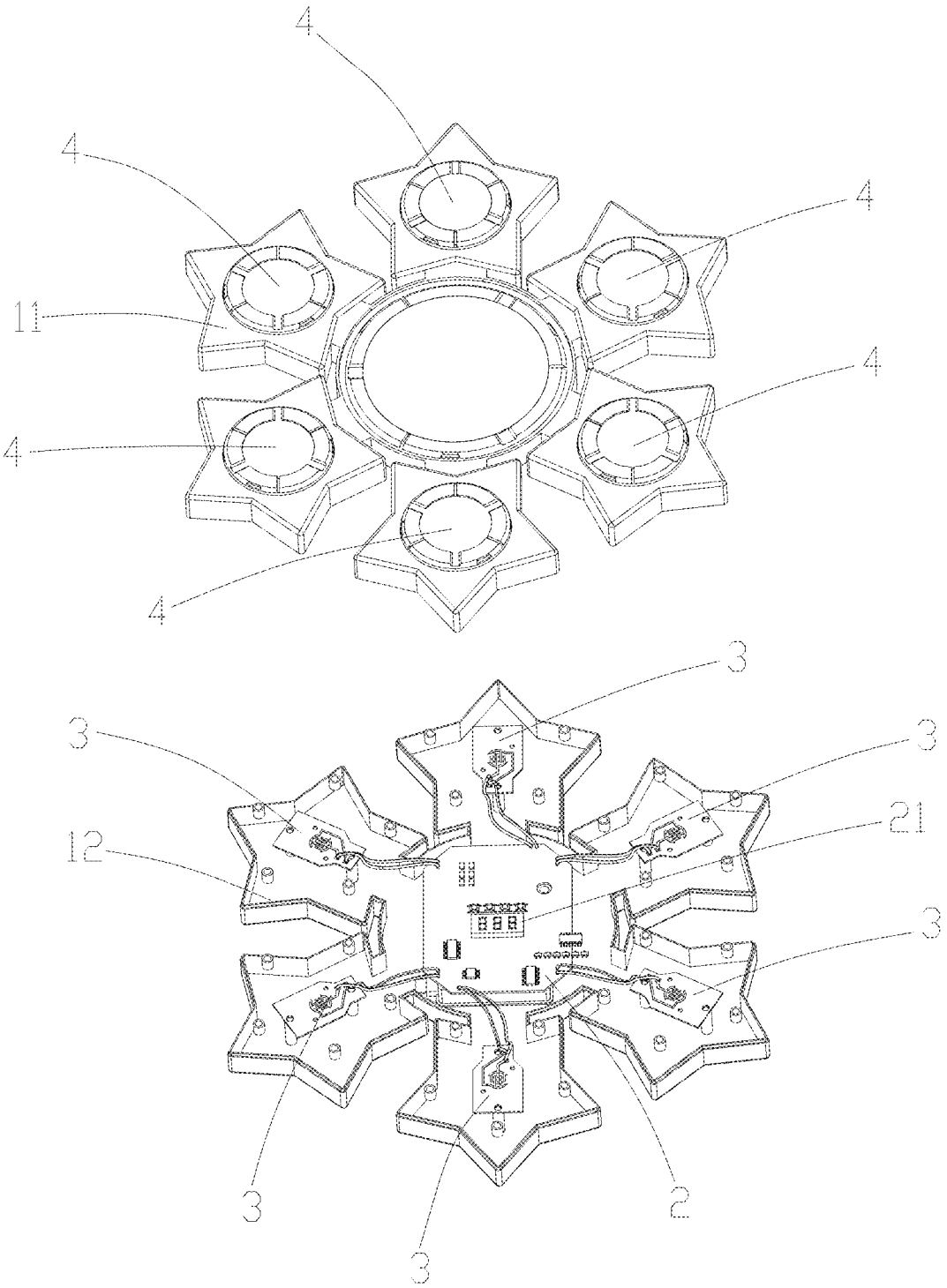
FIG. 12 a schematic view of the boxing entertainment device of FIG. 10 showing an upper housing and striking parts detached from a lower housing.
Figure 13:
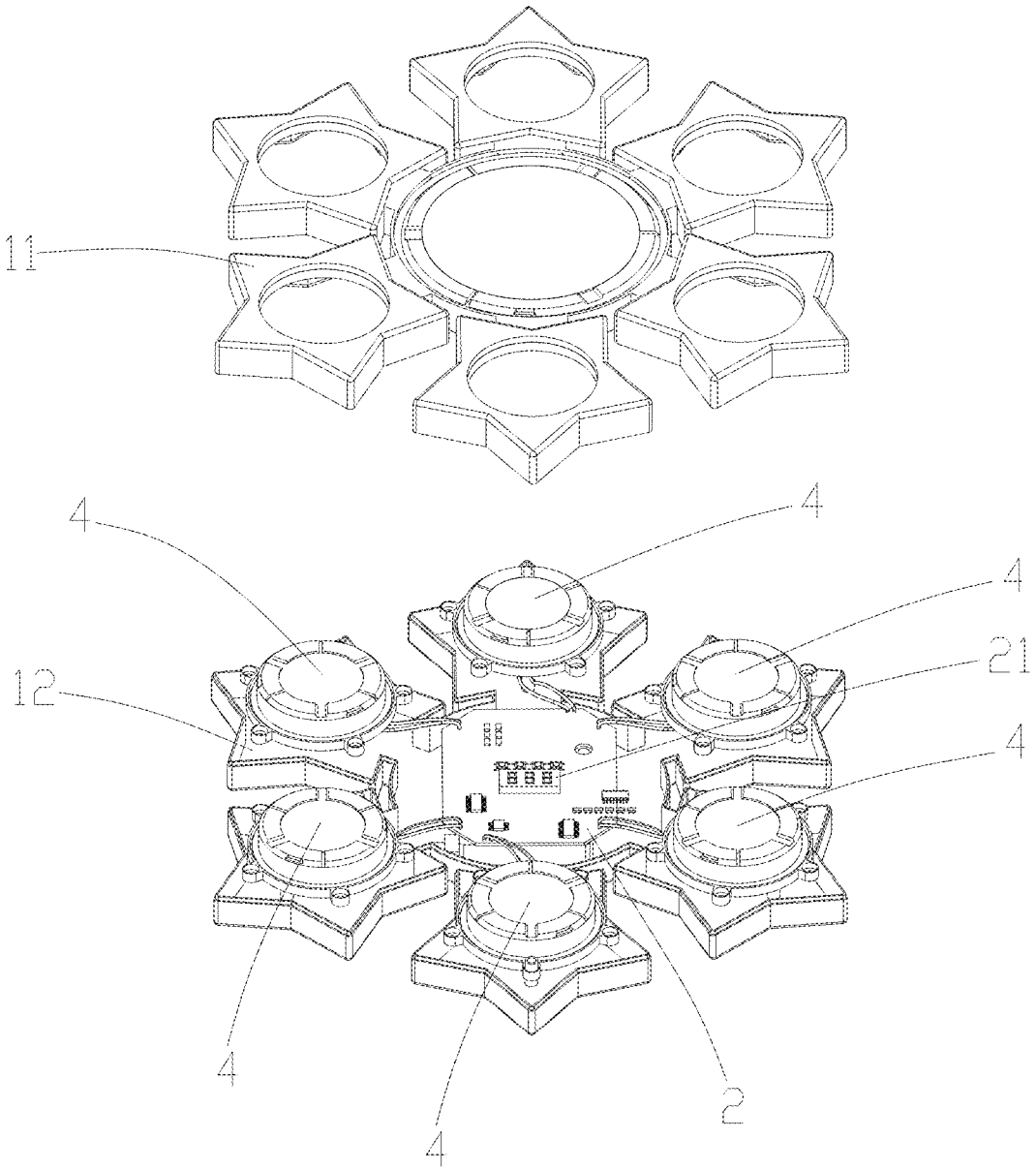
FIG. 13 is a schematic view of the boxing entertainment device of FIG. 10 showing the upper housing detached from the lower housing.
Figure 14:
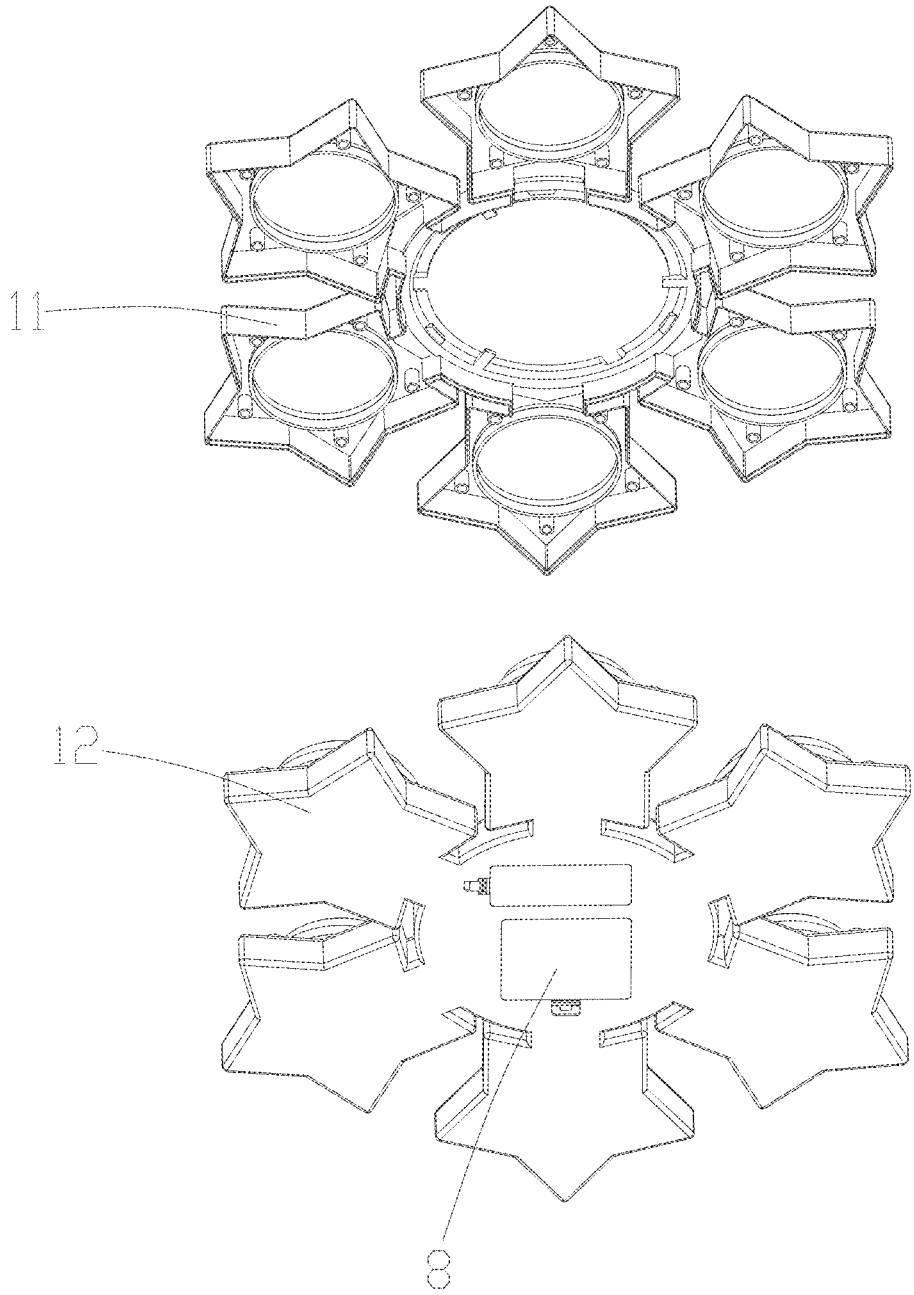
FIG. 14 is a schematic view of the boxing entertainment device of FIG. 13 from another angle.
Figure 15:
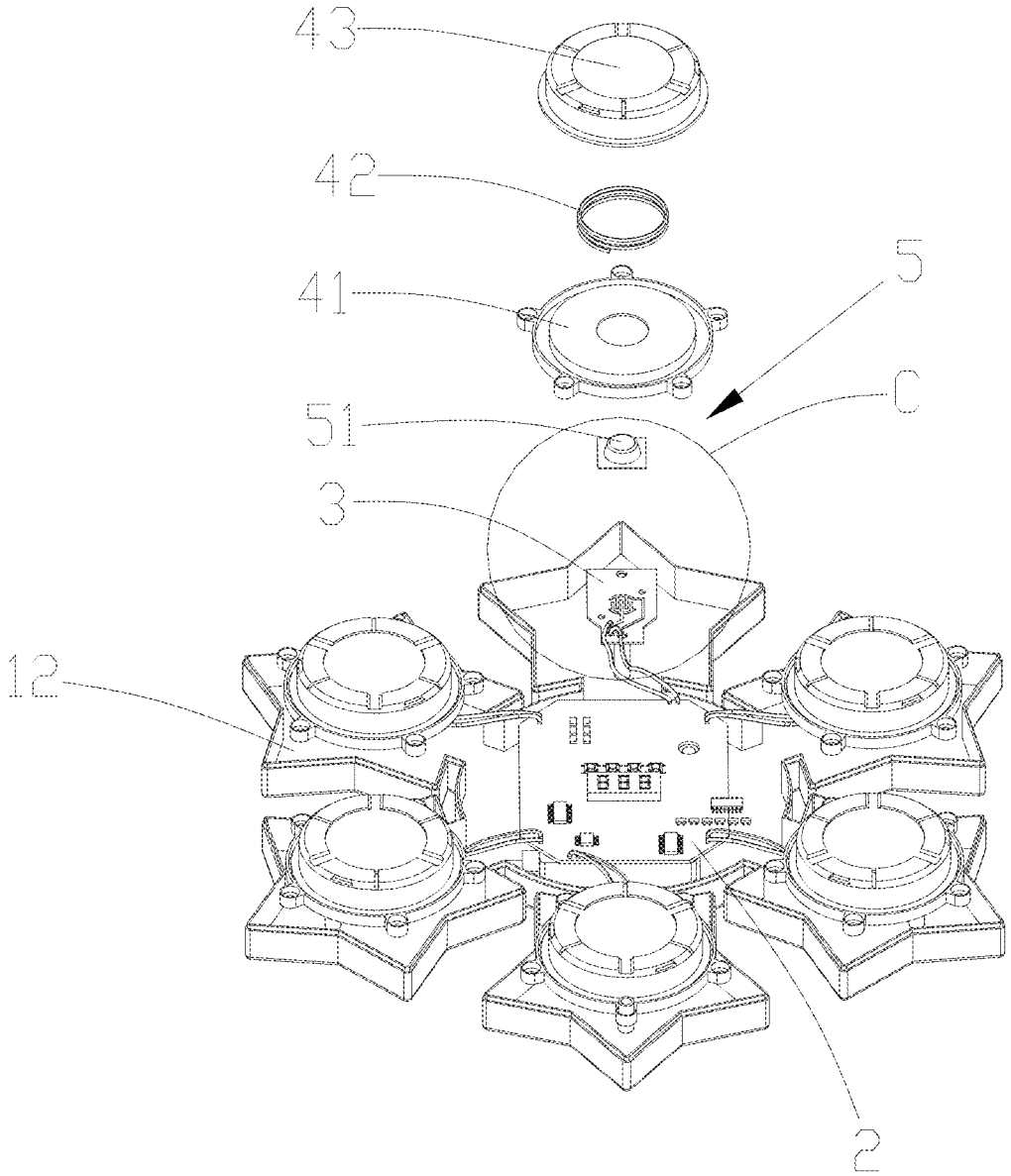
FIG. 15 is a is a schematic view of the boxing entertainment device of FIG. 10 with a first embodiment of a striking detector, the upper housing being not shown.
Figure 16:
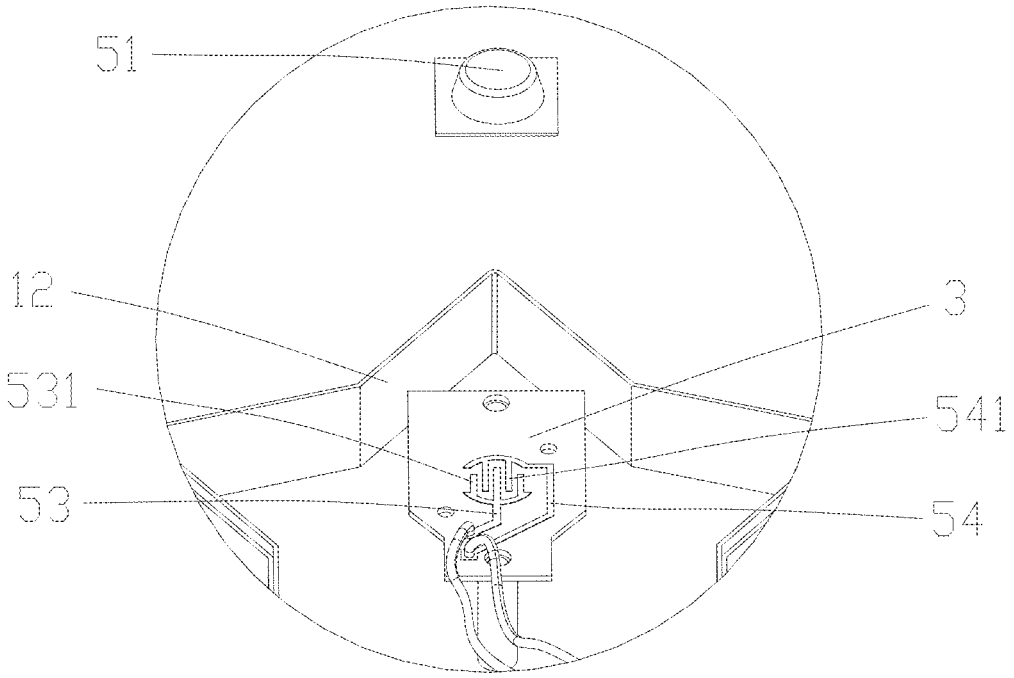
FIG. 16 is an enlarged view of the portion C shown in FIG. 15.
Figure 17:
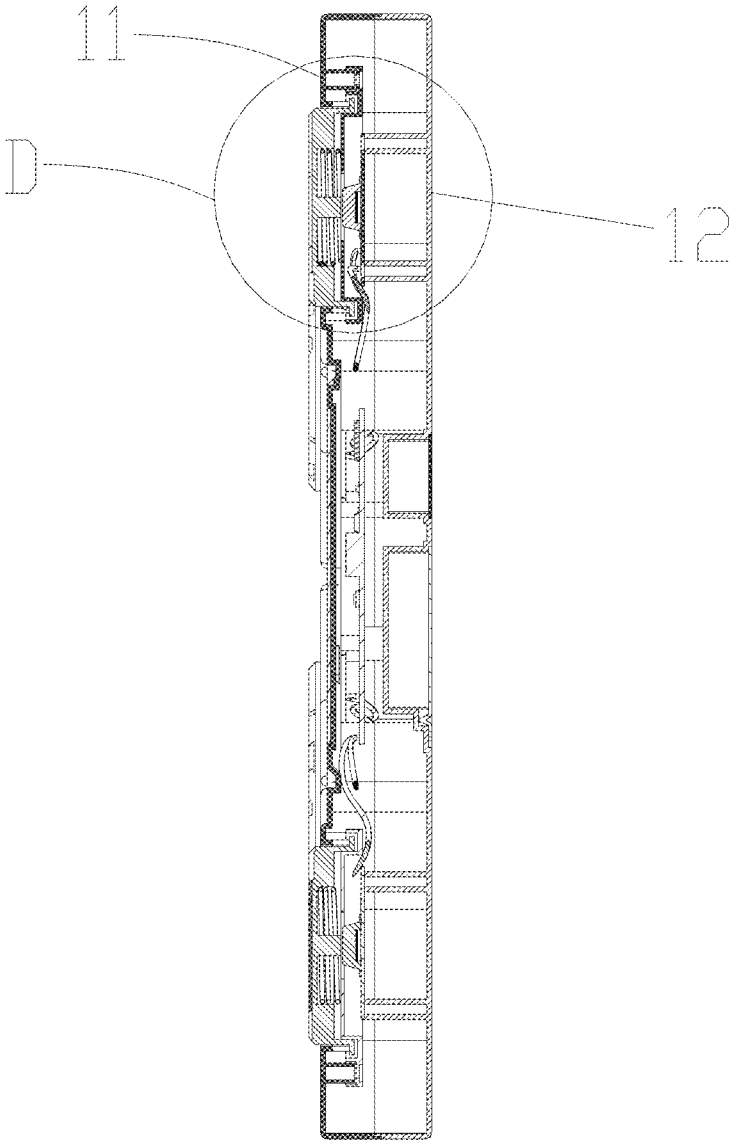
FIG. 17 is a cross-sectional view of the boxing entertainment device of FIG. 10 with the first embodiment of the striking detector, the upper housing being not shown.
Figure 18:
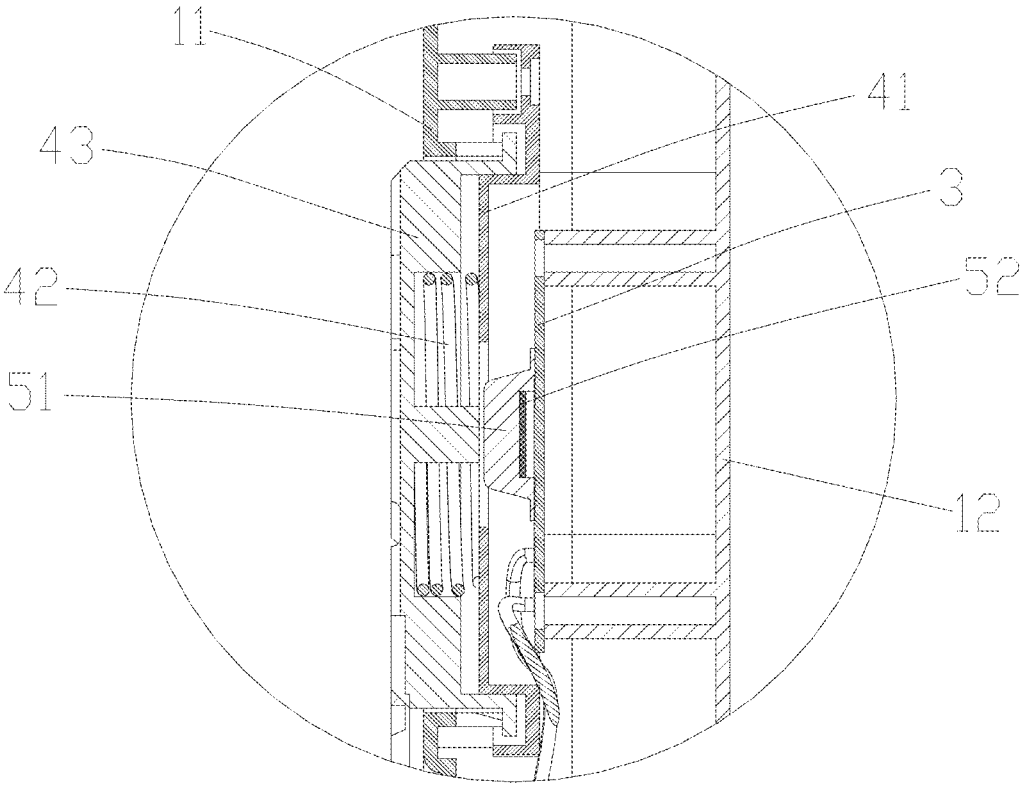
FIG. 18 is an enlarged view of the portion D shown in FIG. 17.

Please referring to FIGS. 1-24, a boxing entertainment device provided by an embodiment of the present disclosure includes a housing 1, a main circuit board 2 and a plurality of sub circuit boards 3 arranged in the housing 1. Each sub circuit board 3 is electrically connected to the main circuit board 2. The plurality of sub circuit boards 3 are arranged in array.

The housing can be in many kinds of shapes. Referring to FIGS. 1-9 and FIGS. 19-23, the housing is in a first shape, and referring to FIGS. 10-18, the housing is in a second shape.

Through above structural configurations, the main circuit board and multiple sub circuit boards are installed within the housing, enabling a more flexible and rational layout of circuit boards in the boxing entertainment device. Additionally, electronic components on the main and sub circuit boards can be arranged according to practical requirements, effectively avoiding redundant or wasted space on the circuit boards.

Specifically, the housing 1 is equipped with multiple striking parts 4. Each striking part 4 corresponds to a sub circuit board 3, and each sub circuit board 3 is integrated with a striking detector 5. When a striking part 4 is struck, it triggers the corresponding striking detector 5. In operation, users can strike any striking part 4 on the housing with their fist, activating the corresponding detector. Each striking detector 5 then identifies the striking action and transmits signals back to the main circuit board via the corresponding sub circuit board 3. In at least one embodiments, components such as a display screen 21 and LED lights can be arranged on the main circuit board 2 and configured to provide real-time feedback on strike success, strike count, etc. Furthermore, data can be transmitted to mobile phones or other terminal devices via Bluetooth®, Wi-Fi, or similar wireless protocols for users to view.

Additionally, the striking parts 4 and the sub circuit boards 3 are arranged in a one-to-one correspondence and each sub circuit board 3 correspond is provided with the corresponding striking detector 5. Each sub circuit board only needs to have space to accommodate the corresponding striking detector 5; there is no requirement for the sub circuit boards 3 to cover reserved spaces between each two adjacent striking parts 4. This allows for more flexible and rational layout of the circuit boards within the boxing entertainment device, effectively preventing excess and wastage of circuit board space.

Additionally, the number of the sub circuit boards 3 may be 5, 6 or more, accordingly, the number of the striking parts 4 can be 5, 6 or more. It can be understandable that the number of the sub circuit boards 3 and the number of the striking parts 4 can be adjusted to any suitable number based on specific requirements, as long as the number of the striking parts 4 being same with that of the sub circuit boards 3.

The striking parts 4 are elastic. This not only enhances user safety during strikes but also protects the striking detectors from physical damage.

Referring to FIGS. 1-18, especially referring to FIGS. 6-9 and FIGS. 15-18, in a first embodiment of the striking detector, the striking detector 5 may be a press-type striking detector.

Specifically, the press-type striking detector includes a first elastic button 51, a conductive portion 52, a first conducting pin 53, and a second conducting pin 54. The conductive portion 52 is disposed at a bottom of the first elastic button 51. Both the first conducting pin 53 and the second conducting pin 54 are electrically connected to the sub circuit board 3 and are in a constantly disconnected state. When the striking part 4 is struck, it exerts a force on the first elastic button 51, causing it to elastically deform. The conductive portion 52 at the bottom of the first elastic button 51 then electrically connects the first conducting pin 53 and the second conducting pin 54. Moreover, when the first elastic button returns to its original position elastically, the conductive portion is separated from the first conducting pin 53 and the second conducting pin 54 to have the first conducting pin 53 and the second conducting pin 54 return to the constantly disconnected state. In this configuration, the press-type striking detector function as a contact switch to connect the circuit. By pressing the first elastic button 51, the circuit is closed, and a signal is fed back to the main circuit board via the sub circuit board to confirm a successful strike, thereby triggering the striking detector.

The first elastic button 51 can be made of a silicone material. There are various ways to fix the first elastic button 51 onto the sub circuit board 3; for example, it can be secured by interlocking or by adhesive bonding with an insulating glue, which is not limited herein. The conductive portion 52 can be a graphite sheet.

Furthermore, both the first conducting pin 53 and the second conducting pin 54 are printed on the sub circuit board 3.

Additionally, the first conducting pin 53 is equipped with multiple first prongs 531 arranged in parallel, and the second conducting pin 54 is equipped with multiple second prongs 541 arranged in parallel. The first prongs 531 and the second prongs 541 are staggered with each other to ensure that the first conducting pins 531 and the second conducting pins 541 remain in a constantly disconnected state. Moreover, the electrical connection between the first conducting pin 53 and the second conducting pin 54 is achieved when the conductive portion 52 touches a group of any one the first prong 531 and any one of the second prongs 541.

The specific structure of each elastic striking part can be as follows: the striking part 4 includes a base portion 41 arranged on the housing 1, an elastic member 42, and a striking contact portion 43 arranged above the corresponding sub circuit board 3 and exposed outside the housing 1. The elastic member 42 is disposed between the base portion 41 and the striking contact portion 43. When the striking contact portion 43 is struck and compresses the elastic member 42, it can exerts a force on the first elastic button 51 to trigger the striking detector 5. When the user's first is withdrawn, the striking contact portion 43 returns to its original position under the elastic restoring force of the elastic member 42.

Furthermore, the elastic member 42 can be a spring. The housing 1 may include an upper housing 11 and a lower housing 12. The base portion 41 is fixed to the upper housing 11, and the striking contact portion 43 is exposed outside the upper housing 11. Both the main circuit board 2 and the sub circuit boards 3 are fixed to the lower housing 12. Additionally, a speaker 7 is arranged in the lower housing 12 and configured to play music for rhythmic boxing entertainment, enhancing the fun. The lower housing 12 has a battery compartment 8 where batteries can be installed to supply power to the main circuit board 2 and the sub circuit boards 3.

Alternatively, in other embodiments, the specific structure of the elastic striking part 4 may be: the striking part 4 is integrally made of an elastic material. For example, it can be an integrally molded cushion.

Figure 19:
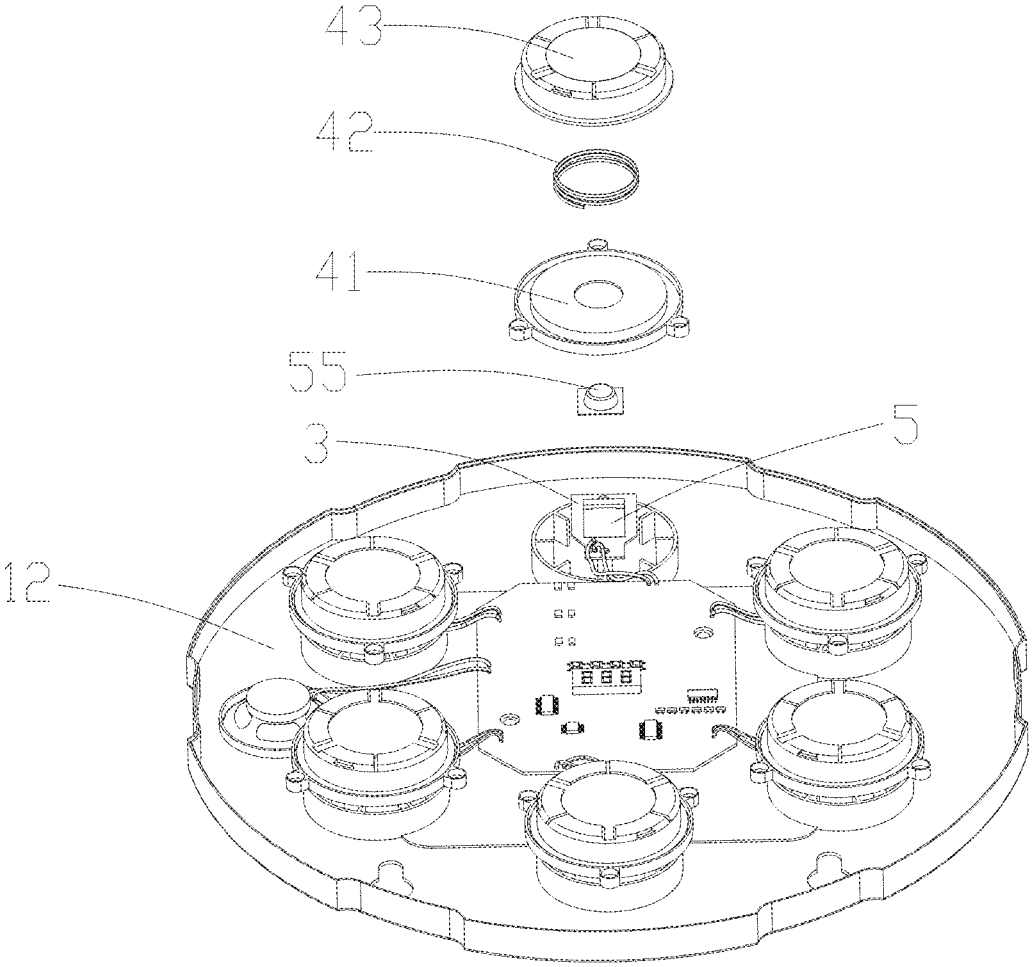
FIG. 19 is a schematic view of the boxing entertainment device of FIG. 1 with a second embodiment of the striking detector, the upper housing being not shown.
Figure 20:
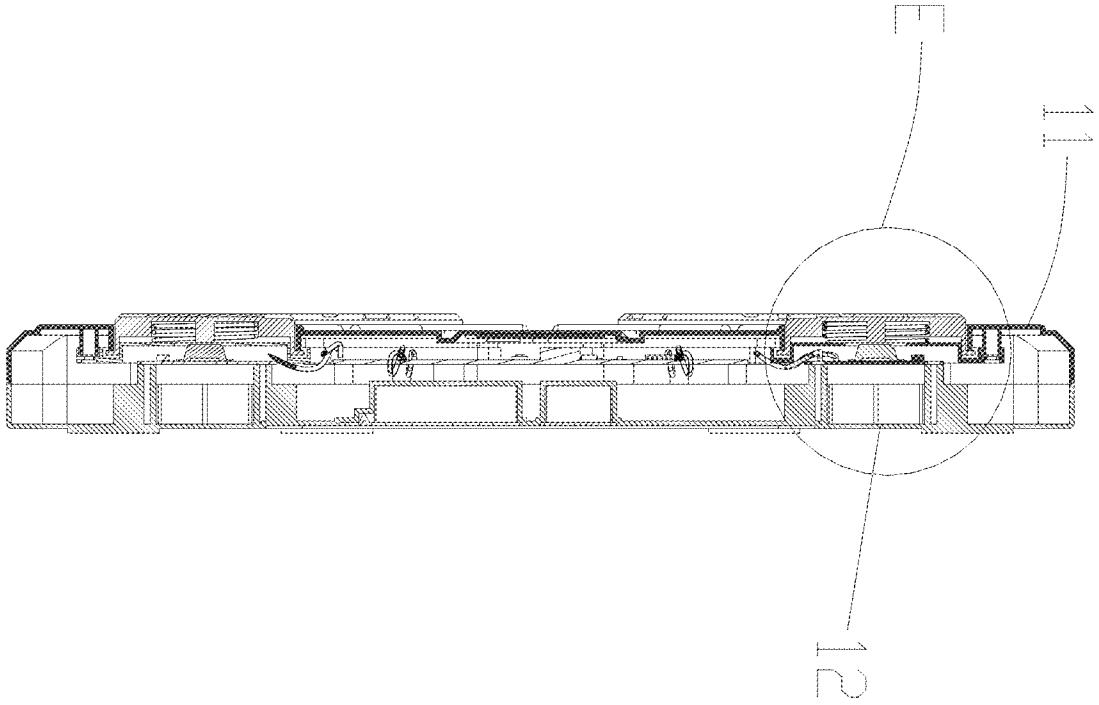
FIG. 20 is a cross-sectional view of the boxing entertainment device of FIG. 1 with the second embodiment of the striking detector.
Figure 21:
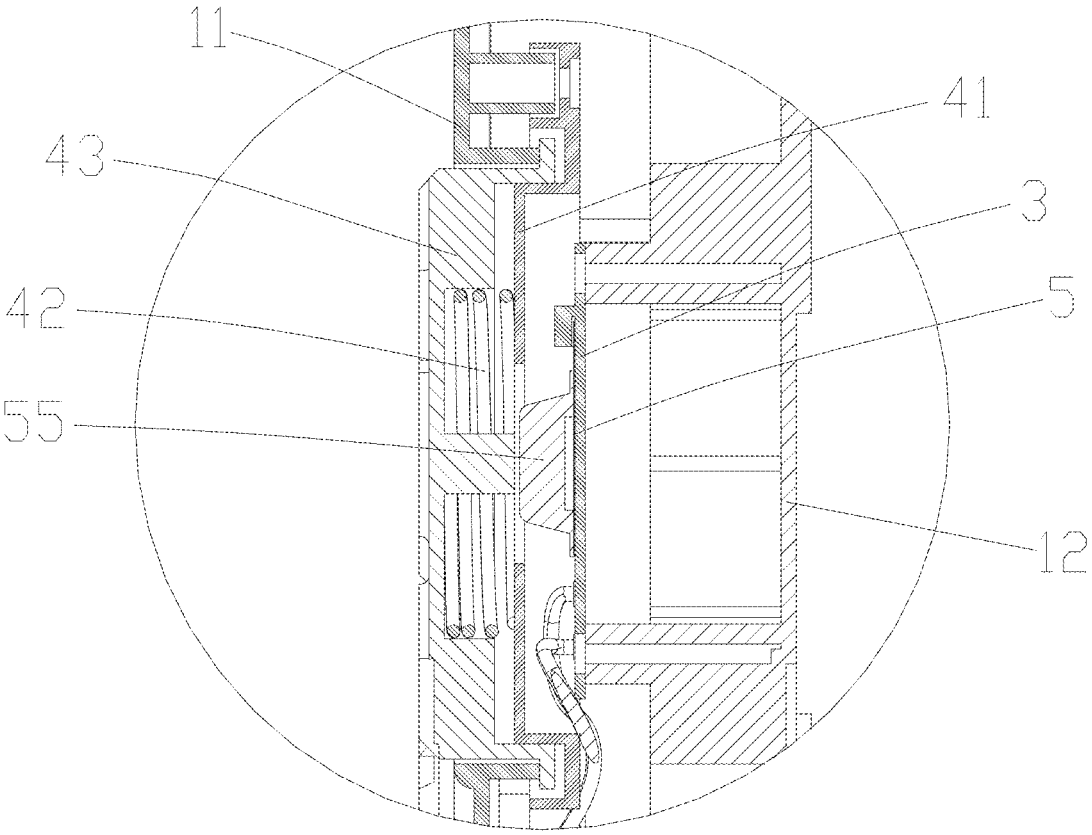
FIG. 21 is an enlarged view of the portion E shown in FIG. 20.

Referring to FIGS. 1-5 and FIGS. 19-21, especially referring to FIGS. 19-21, in a second embodiment of the striking detector, the striking detector 5 may be a sensor-type striking detector.

Specifically, the sensor-type striking detector is a pressure sensor, which is electrically connected to the sub circuit board 3.

Furthermore, the boxing entertainment device further includes a second elastic button 55 disposed on the pressure sensor. When the striking part 4 is struck, the striking part 4 exerts a force on the second elastic button 55 to cause the second elastic button 55 to deform elastically and to transmit the striking force to the pressure sensor. The pressure sensor feeds a signal back to the main circuit board via the corresponding sub circuit board to confirm a successful strike, thereby triggering the striking detector. Additionally, the pressure sensor can record force data to provide feedback to the user.

The second elastic button 55 can be made of a silicone material, and there are various ways to secure the second elastic button 55 to the corresponding sub circuit board 3. For example, it can be secured by interlocking or by adhesive bonding with an insulating glue, which is not limited herein. The pressure sensor is a thin-film pressure sensor.

The specific structure of each elastic striking part can be as follows: the striking part 4 includes a base portion 41 arranged on the housing 1, an elastic member 42, and a striking contact portion 43 arranged above the corresponding sub circuit board 3 and exposed outside the housing 1.

The elastic member 42 is disposed between the base portion 41 and the striking contact portion 43. When the striking contact portion 43 is struck and compresses the elastic member 42, it can exert a force on the second elastic button 55 to trigger the striking detector 5. When the user's first is withdrawn, the striking contact portion 43 returns to its original position under the elastic restoring force of the elastic member 42.

Furthermore, the elastic member 42 can be a spring. The housing 1 may include an upper housing 11 and a lower housing 12. The base portion 41 is fixed to the upper housing 11, and the striking contact portion 43 is exposed outside the upper housing 11. Both the main circuit board 2 and the sub circuit boards 3 are fixed to the lower housing 12. Additionally, a speaker 7 is arranged in the lower housing 12 and configured to play music for rhythmic boxing entertainment, enhancing the fun. The lower housing 12 has a battery compartment 8 where batteries can be installed to supply power to the main circuit board 2 and the sub circuit boards 3.

Figure 22:
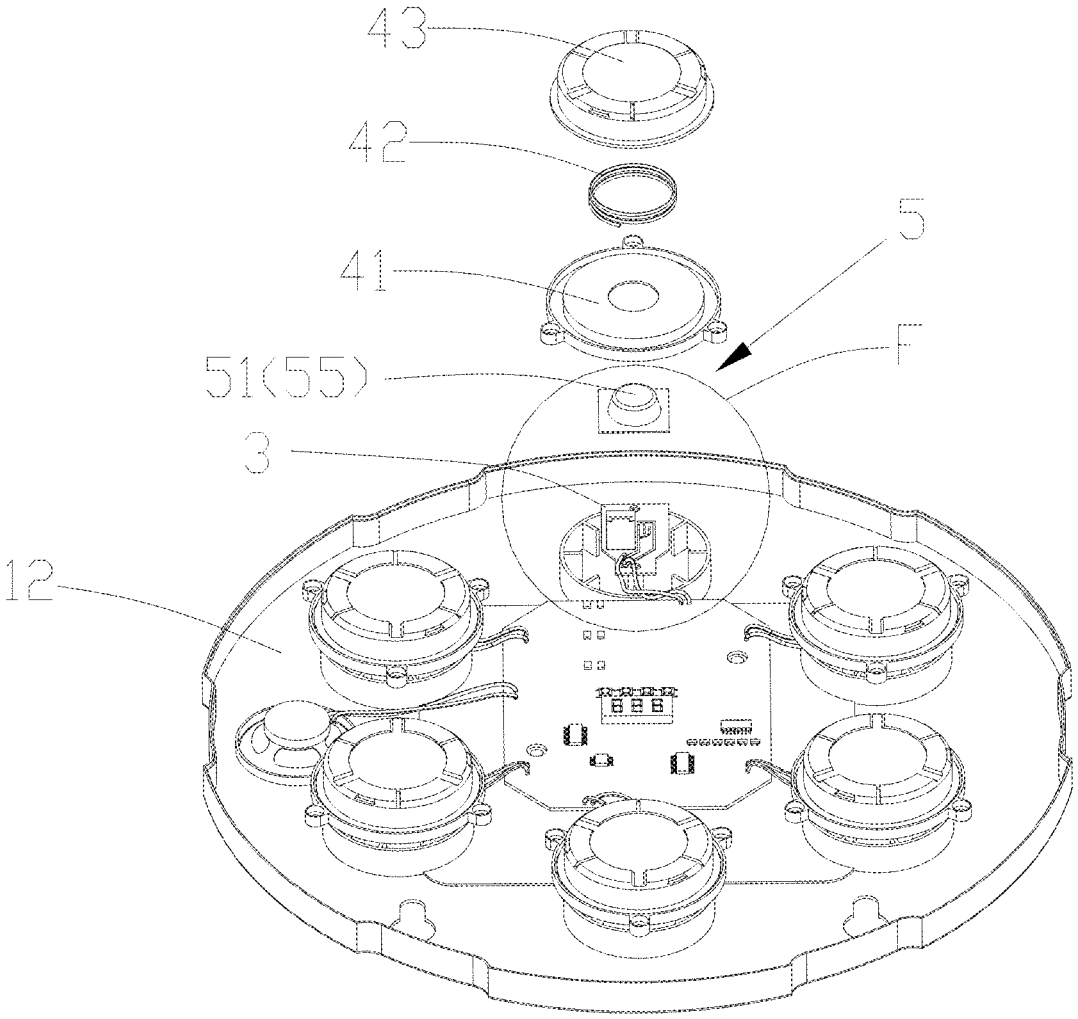
FIG. 22 is a schematic view of the boxing entertainment device of FIG. 1 with a third embodiment of the striking detector, the upper housing being not shown.
Figure 23:
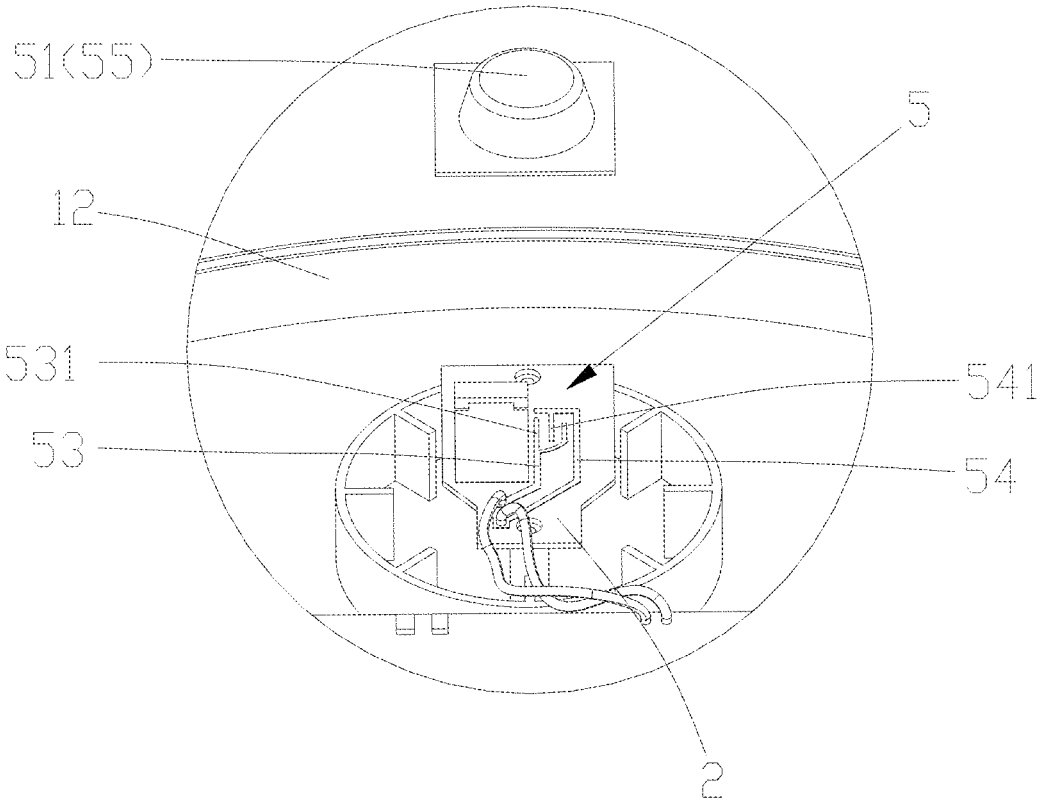
FIG. 23 is an enlarged view of the portion F shown in FIG. 22.

Referring to FIGS. 1-5 and FIGS. 22-23, especially, FIGS. 22-23, in the third example of the striking detector, the striking detector 5 can simultaneously incorporate both a press-type striking detector and a sensor-type striking detector. The specific structures of these two types of striking detectors have been described above and will not be elaborated here. Moreover, to enable simultaneous triggering of both types of striking detectors, the first resilient button and the second elastic button should be the same component.

In the present disclosure, the sub circuit boards 3 are arranged in a circular array. Correspondingly, the striking parts are arranged in a circular array, facilitating user's striking operations on each striking part.

Furthermore, the main circuit board 2 is positioned at a center of the housing 1, and the sub circuit boards 3 are arranged around the main circuit board to form the circular array. This arrangement optimizes use of space within the boxing entertainment device, resulting in a more rational structural layout.

Additionally, the main circuit board 2 and the plurality of sub circuit boards 3 are separately arranged, and the sub circuit boards 3 are separately arranged from one another. Both the main circuit board 2 and the sub circuit boards 3 are independently installed without any direct fixed connections among them.

Figure 24:
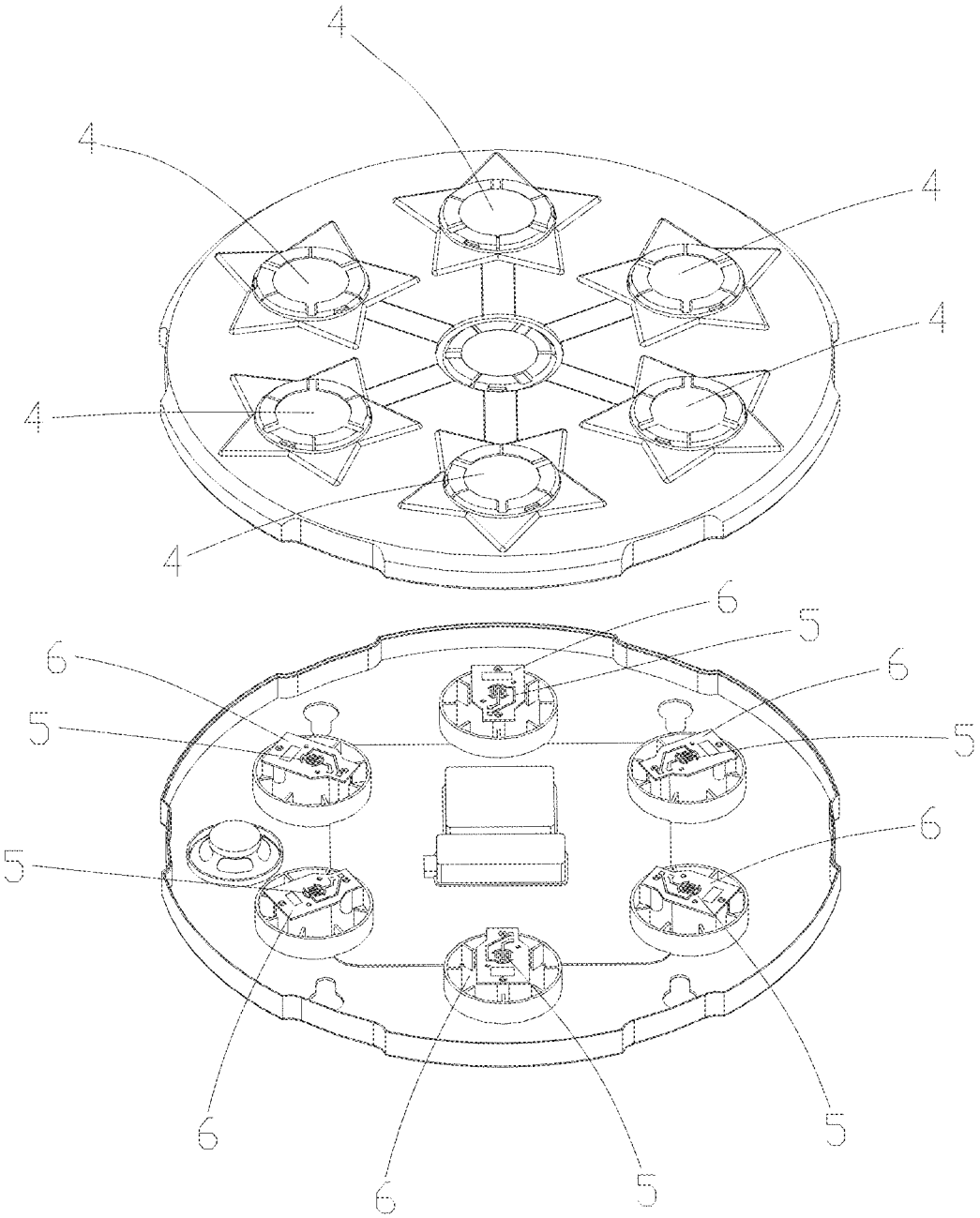
FIG. 24 is an exploded view of a boxing entertainment device according to another embodiment of the present disclosure.

Referring to FIG. 24, another embodiment of the present disclosure provides a boxing entertainment device that includes multiple circuit boards 6 arranged in an array. Specifically, the circuit boards 6 are arranged in a circular array, which is more rational in structural layout. Correspondingly, the boxing entertainment device further includes multiple striking parts 4, with each striking part 4 corresponding to a corresponding one of the circuit boards 6.

Furthermore, a detector 5 is arranged on each circuit board 6. Detailed structures of the detector 5 is same as above embodiments, which will not repeated here. Each circuit board is equipped with electronic modules configured to identify the feedback signals from the detector when the detector is triggered to determine whether striking acted on the striking part is successful.

The above-described embodiments merely illustrate several embodiments of the present disclosure, and the description thereof is relatively specific and detailed, but it should not be construed as limiting the scope of patent protection. It should be pointed out that, for ordinary skilled in the art, several modifications and improvements can be made without departing from the concept of the present disclosure, which all fall within the scope of protection of the present disclosure. Therefore, the protection scope of the present disclosure should be determined by appended claims.

What is claimed is:

1. A boxing entertainment device, comprising:

a housing;

a main circuit board arranged in the housing; and a plurality of sub circuit boards arranged in the housing;

wherein the plurality of sub circuit boards are each electrically connected to the main circuit board and are arranged in an array;

wherein the main circuit board and the plurality of sub circuit boards are each independently installed without any direct fixed connections therebetween; wherein each of the plurality of sub circuit boards is electrically connected to the main circuit board through at least one flexible wire, the at least one flexible wire being configured to provide a non-rigid connection such that a position of each of the plurality of sub circuit boards relative to the main circuit board is not fixed by the non-rigid connection;

wherein the boxing entertainment device further comprises a plurality of striking parts corresponding to the plurality of sub circuit boards respectively, and a plurality of striking detectors arranged on the plurality of sub circuit boards respectively, wherein each of the plurality of striking parts is configured to be triggered in response to being struck;

wherein the plurality of striking parts are elastic;

wherein the plurality of striking detectors comprise press-type striking detectors, sensor-type striking detectors or a combination of the press-type striking detectors and the sensor-type striking detectors;

wherein each of the press-type striking detectors comprises a first elastic button, a conductive portion arranged at a bottom of the first elastic button, a first conducting pin, and a second conducting pin, wherein the first conducting pin and the second conducting pin are in a constantly disconnected state; each of the plurality of striking parts is configured to exert a force on the first elastic button to cause the first elastic button to deform in response to being struck, thus pushing the conductive portion to electrically connect the first conducting pin with the second conducting pin.

2. The boxing entertainment device according to claim 1, wherein the sensor-type striking detectors are press sensors electrically connected to the respective sub circuit boards.

3. The boxing entertainment device according to claim 2, further comprising an elastic button arranged on each of the press sensors, wherein each of the plurality of striking parts is configured to exert a force on a corresponding second elastic button to cause the second elastic button to deform in response to being struck, thus transmitting a striking force to a corresponding press sensor.

4. The boxing entertainment device according to claim 2, wherein the press sensors are thin-film press sensors.

5. The boxing entertainment device according to claim 1, wherein the plurality of sub circuit boards are arranged in the array, the array being a circular array.

6. The boxing entertainment device according to claim 1, wherein the plurality of sub circuit boards are arranged in the array, the array being a circular array.

7. The boxing entertainment device according to claim 6, wherein the main circuit board is arranged at a center of the housing and wherein the plurality of sub circuit boards are arranged surrounding the main circuit board to form the circular array.

8. The boxing entertainment device according to claim 7, wherein the main circuit board is arranged at a center of the housing and the plurality of sub circuit boards are arranged surrounding the main circuit board to form the circular array.

9. The boxing entertainment device according to claim 1, wherein the first conducting pin and the second conducting pin are printed on each of the plurality of sub circuit boards.

10. The boxing entertainment device according to claim 1, wherein the first conducting pin comprises multiple first prongs, wherein the second conducting pin comprises multiple second prongs, and wherein the multiple first prongs and the multiple second prongs are staggered with each other.

11. The boxing entertainment device according to claim 1, wherein the plurality of striking parts are each integrally made of an elastic material.

12. The boxing entertainment device according to claim 1, wherein the main circuit board and the plurality of sub circuit boards are arranged separately, and wherein the plurality of sub circuit boards are arranged separately.

13. A boxing entertainment device, comprising:

a housing;

a main circuit board arranged in the housing; and a plurality of sub circuit boards arranged in the housing;

wherein the plurality of sub circuit boards are each electrically connected to the main circuit board and are arranged in an array;

wherein the main circuit board and the plurality of sub circuit boards are each independently installed without any direct fixed connections therebetween; wherein each of the plurality of sub circuit boards is electrically connected to the main circuit board through at least one flexible wire, the at least one flexible wire being configured to provide a non-rigid connection such that a position of each of the plurality of sub circuit boards relative to the main circuit board is not fixed by the non-rigid connection;

wherein the boxing entertainment device further comprises a plurality of striking parts corresponding to the plurality of sub circuit boards respectively, and a plurality of detectors arranged on the plurality of sub circuit boards respectively, wherein each of the plurality of striking parts is configured to be triggered in response to being struck; wherein the plurality of striking parts are elastic;

wherein each striking part comprises a base portion arranged on the housing, an elastic member, and a striking contact portion arranged above a corresponding one of the sub circuit boards and exposed outside the housing, wherein the elastic member is arranged between the base portion and the striking contact portion, the striking contact portion is configured to exert a force on a corresponding one of the plurality of striking detectors to trigger the corresponding one of the plurality of striking detectors.

14. A boxing entertainment device, comprising:

a housing;

a main circuit board arranged in the housing; and a plurality of sub circuit boards arranged in the housing;

wherein the plurality of sub circuit boards are each electrically connected to the main circuit board and are arranged in an array;

wherein the main circuit board and the plurality of sub circuit boards are each independently installed without any direct fixed connections therebetween; wherein each of the plurality of sub circuit boards is electrically connected to the main circuit board through at least one flexible wire, the at least one flexible wire being configured to provide a non-rigid connection such that a position of each of the plurality of sub circuit boards relative to the main circuit board is not fixed by the non-rigid connection;

wherein the boxing entertainment device further comprises a plurality of striking parts corresponding to the plurality of sub circuit bards respectively, and a plurality of striking detectors arranged on the plurality of sub circuit bards respectively, wherein each of the plurality of striking parts is configured to be triggered in response to being struck;

wherein a number of the plurality of sub circuit boards is 5 or 6, correspondingly, a number of the plurality of striking parts is 5 or 6.

* * * * *